US005110057A

United States Patent [19]

Karra et al.

[11] Patent Number: 5,110,057

[45] Date of Patent: May 5, 1992

[54] METHOD OF HIGH PERFORMANCE JAW CRUSHING

[75] Inventors: Vijia K. Karra, Franklin; Anthony J. Magerowski, Milwaukee; Scot E. Szalanski, Oak Creek, all of Wis.

[73] Assignee: Nordberg Inc., Milwaukee, Wis.

[21] Appl. No.: 623,017

[22] Filed: Dec. 6, 1990

[51] Int. Cl.[5] ..... B02C 1/02

[52] U.S. Cl. ..... 241/30; 241/266

[58] Field of Search ..... 241/207-216, 241/264-269, 30, 33, 37

[56] References Cited

U.S. PATENT DOCUMENTS

| | | | |
|---|---|---|---|
| 2,341,105 | 2/1944 | Kleneman et al. . | |
| 2,532,678 | 12/1950 | Shelton . | |
| 2,591,639 | 4/1952 | Traylor, Jr. . | |
| 2,738,933 | 3/1956 | Dougherty . | |
| 3,219,287 | 11/1965 | Weiss . | |
| 3,894,698 | 7/1975 | Falk . | |
| 4,124,170 | 11/1978 | Braun et al. . | |
| 4,398,674 | 8/1983 | Dremann . | |
| 4,410,145 | 10/1983 | Koch . | |
| 4,671,464 | 6/1987 | Karra et al. | 241/30 X |
| 4,697,745 | 10/1987 | Sawant . | |
| 4,967,967 | 11/1990 | Magerowski et al. | 241/30 X |

OTHER PUBLICATIONS

Broman, J., *Optimizing Capacity and Economy in Jaw and Gyratory Crushers,* Engineering and Mining Journal, Jun. 1984, pp. 69-71.

Gauldie, K., *The Performance of Jaw Crushers,* Engineering, Oct. 9, 1953, pp. 456-458.

Lowrison, G., *Crushing and Grinding: The Size Reduction of Solid Materials,* CRC Press, Inc., 1974, pp. vi-viii, 140-145 and 190.

Prasher, C., *Crushing and Grinding Process Handbook,* John Wiley & Sons, Ltd. 1987, pp. 244-247.

*Primary Examiner*—Mark Rosenbaum

*Attorney, Agent, or Firm*—Welsh & Katz, Ltd.

[57] ABSTRACT

A method of operating a jaw crusher having a specified speed, a specific throw, and a specified horsepower draw to achieve a specified crushing force and a resulting crusher throughput capacity includes increasing the throw over the specified level and maintaining or decreasing the speed below the specified level so that the crusher capacity is increased without increasing the crushing force.

4 Claims, 2 Drawing Sheets

METHOD OF HIGH PERFORMANCE JAW CRUSHING

BACKGROUND OF THE INVENTION

The present invention relates generally to methods of operating mineral comminution machinery to obtain optimum performance, and specifically relates to such a method of operating a crusher such as a jaw crusher.

Conventional mineral crushers such as jaw crushers or conical crushers share operating parameters and performance characteristics such as stroke or head throw, eccentric speed, horsepower draw, throughput capacity and crushing force. Crusher stroke may be defined as the displacement of the head or jaw between widest and narrowest points on an eccentrically gyrating cycle. Eccentric speed is self explanatory, while horsepower draw is the amount of power consumed, and is a function of stroke, crushing force and eccentric speed. Throughput capacity is described in terms of tons per hour, and crushing force is generally represented by dividing horsepower by the product of stroke and eccentric speed.

A longstanding problem in the operation of such machines is the adjustment of the above-identified parameters so that capacity is maximized while the crushing force is maintained below a machine-specific maximum design level. More particularly, in regard to jaw crushers, the object is to increase capacity by increasing horsepower draw without increasing normal crushing force. If the crushing force is increased, the crusher frame will necesarily need to be strengthened in order to withstand the higher crushing loads normally associated with increased horsepower. However, conventional crushing theory dictates that if horsepower is increased, so will the crushing force.

Thus, an object of the present invention is to provide a method of adjusting a jaw crusher in order to increase capacity without increasing crushing force.

Another object of the present invention is to provide a method of adjusting a jaw crusher in which an optimum combination of horsepower, stroke and speed will be established to obtain optimum throughput capacity.

SUMMARY OF THE INVENTION

Accordingly, the present invention provides a method of adjusting a crusher, and preferably a jaw crusher, in which the throw is increased and the speed is maintained or decreased. It has been found that by making such adjustments, the crusher capacity increases without increasing crushing force above the design limit for the particular machine.

More specifically, the present invention includes a method of operating a crusher having a specified speed, a specified throw, and a specified horsepower draw to achieve a specified crushing force and a resulting crusher throughput capacity. The present method includes increasing the throw over the specified level and maintaining or decreasing the speed below the specified level so that the crusher capacity is increased without increasing the crushing force.

DETAILED DESCRIPTION OF THE PREFERRED EMBODIMENT

Figure 1:
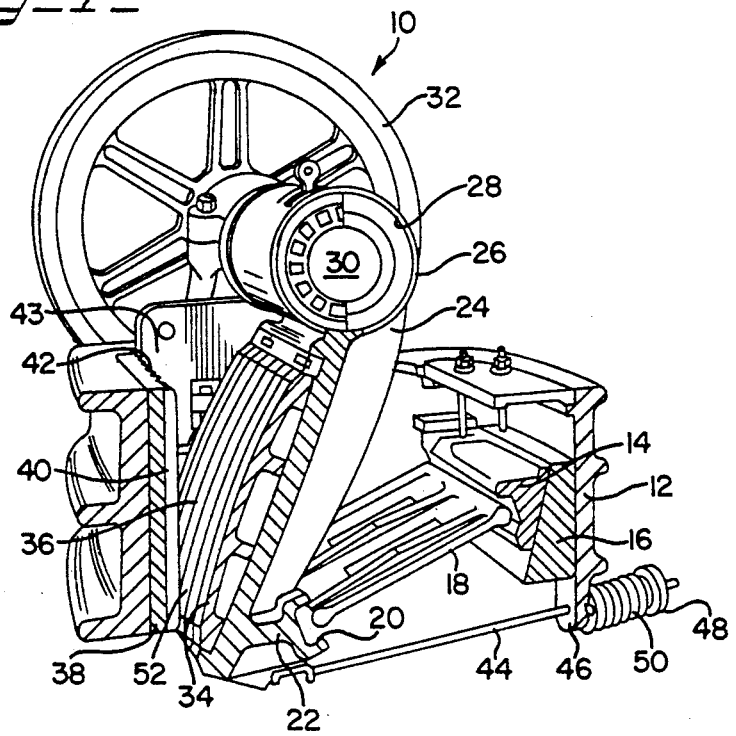
FIG. 1 is a side perspective elevational view, in partial section, of a jaw crusher of the type which may employ the present method.

Referring now to FIG. 1, a jaw crusher is generally indicated at 10. The jaw crusher 10 is depicted as a single-toggle type machine, however it is contemplated that double-toggle or other types of jaw crushers, as well as other crushers, as described below, may also benefit from the present method. The crusher 10 includes a main frame 12 of basically rectangular configuration having a toggle block 14 and an adjusting wedge 16 mounted on an inner surface of the main frame. A toggle 18 is supported by the toggle block 14 and by a transverse channel 20 located at a lower end 22 of a movable jaw 24. An upper end 26 of the jaw 24 is provided with a transverse tubular sleeve 28 which is journalled to accept a rotating eccentric shaft 30. The shaft 30 is connected at one end to a flywheel 32 and at the other end to a drive mechanism (not shown), such as a belt and pulley system as is well known in the art.

A removable jaw plate or jaw die 34 is secured to the movable jaw 24, and may preferably be provided with an irregular surface including vertical ribs or corrugations 36 to facilitate the gripping of feed material. A fixed jaw 38 is disposed on the frame 12 so as to be opposite the movable jaw 24 and is provided with a removable jaw plate or die 40. As is the case with the die 34, the die 40 is preferably provided with a plurality of vertical ribs 42. The jaws 24 and 38 are disposed relative to each other to define a generally V-shaped crushing cavity 43.

A drawback rod 44 is secured to the lower end 22 of the jaw 24 and also passes through an eyelet 46 in the frame 12. A cover plate 48 attached to the rod 44 secures a coiled spring 50 upon the rod and holds the spring against the eyelet 46.

During operation, rotation of the eccentric shaft 30 causes the movable jaw 24 to follow an elliptical rotation which is well known in the art. The movement of the lower end 22 of the movable jaw 24 is controlled by the action of the toggle 18 and the spring-biased drawback rod 44. Feed material introduced at the upper end of the crushing cavity 43 is gradually comminuted through exposure to repeated squeezing strokes of the movable jaw 24 against the fixed jaw 38 in the progressively narrowing cavity.

The toggle 18 supports the lower end 22 of the jaw 24, and the spring-biased rod 44 facilitates the cyclical return of the lower jaw end 22 to the base position shown in FIG. 1. In the base position, the lowermost points of the respective jaw dies 34, 40 are at their closest positions, i.e., they define a narrowest gap 52 for the passage of crushed feed material.

Conventional jaw crushing design practice dictates that maximum crusher capacity is defined as:

$$\text{capacity (C)} = (f \cdot p \cdot w \cdot q \cdot a \cdot r) \cdot l \cdot N$$

where f is a constant, p is the bulk density of the product, w is the width of the crushing chamber in inches, q is the open-side setting of the crusher in inches, a is the nip angle factor, r is the Giesking realization factor, l is the stroke, and N is the number of strokes per minute or speed. In a practical sense, in order to increase crusher capacity, the jaws are often made wider, which also entails a heavier and costlier machine. Thus, aside from jaw width, of the remaining variables in the above equation, only stroke and stroke speed appear to be variables which are capable of alteration. The equation also indicates that changes in stroke and speed have an equivalent effect on crusher capacity.

Conventional crusher design theory further dictates that $$\text{Horsepower} = \text{crushing force} \cdot \text{stroke} \cdot \text{RPM}$$

or $$\text{crushing force} = \frac{\text{Horsepower}}{\text{stroke} \cdot \text{RPM}}$$

Thus, it would appear that since stroke and speed are directly proportional to crusher capacity, and inversely proportional to crushing force, an increase in capacity without increasing force could be achieved by merely increasing speed and/or throw. As was the case with the capacity equation, speed and stroke appear to be equivalent in their effect on crushing force. However, it has been observed (Rose, H. E., and English, J. E. (1967), 'Theoretical analysis of the performance of jaw crushers', *Trans. IMM (London)*, 76, C32–C43) that there is a critical speed below which speed is proportional to capacity, and above which speed is inversely proportional to capacity.

From the above information, one would be led to assume that speed is the most critical variable in obtaining the object of increasing capacity without increasing crushing force. However, the work of the present inventors revealed that it is throw, not speed which plays the more significant role in this relationship.

Figure 2:
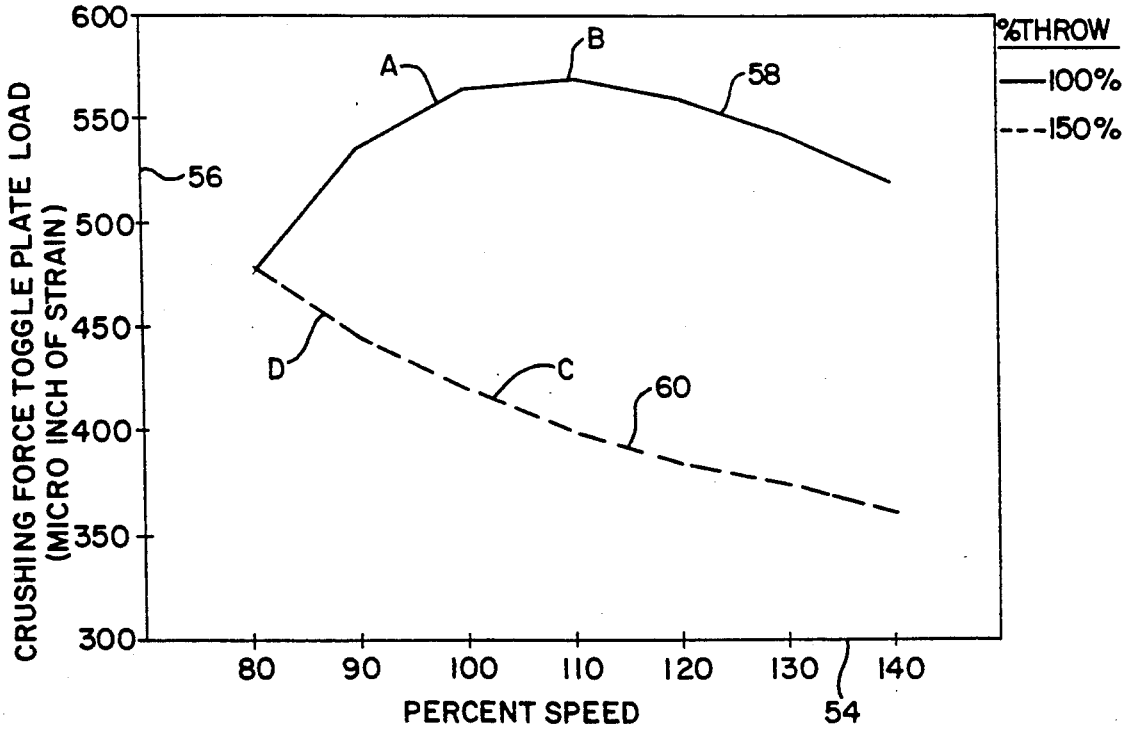
FIG. 2 is a graphical representation of the relationship of crushing force toggle plate load for a jaw crusher compared with percent speed, for crushers adjusted for 100% and 150%, respectively, of specified throw.

Referring now to FIG. 2, a graphical representation of tests results depicts the relationship of percent speed, represented on the x-axis 54, and crushing force toggle plate load, represented on the y-axis 56. The toggle plate 18 which supports the lower end of the movable jaw 24 carries the main loading developed during the crushing process, therefore, the toggle plate loading varies directly with the crushing force. The solid line 58 indicates 100% throw, or the designated throw for the machine tested. The dashed line 60 represents 150% throw over the designated throw for the machine tested. Early tests indicated that if horsepower, stroke, or speed are modified independently, there is a critical value for each parameter beyond which the crusher will begin to operate at a lower than optimum performance. It was also found that jaw crusher performance is reduced the greater the horsepower, stroke and speed are changed from their critical values.

At point A, the intersection of 100% throw with 100% speed, the crushing force or strain on the crusher 10 is slightly over 550 micro inches of strain. At approximately 112% speed, if throw is maintained, the strain on the machine reaches a maximum at point B, beyond which the strain on the machine decreases slightly. Even at 140 percent speed, the force value is still approximately 525 micro inches of strain.

However, the line 60 indicates that if throw is increased to approximately 150% of the designated value for the machine, and if speed is maintained constant, the strain on the machine indicated at point C, will be substantially reduced from that shown at point A, to approximately 425 micro inches of strain. Apparently then, changes in throw have a more significant effect on the stress loading on the crusher than do changes in speed. With an increase in throw and a decrease in speed, as shown at point D, substantial increases in throughput capacity and connected motor power can be achieved without changing the structural design of the crusher. It is thus preferred that throw be increased to a greater degree than any reduction in speed in order to increase capacity while decreasing the machine stress loads. In practical terms, the stroke of the jaw crusher 10 is increased by replacing the specified or standard eccentric shaft 30 with a shaft having a modified diametric configuration.

Figure 3:
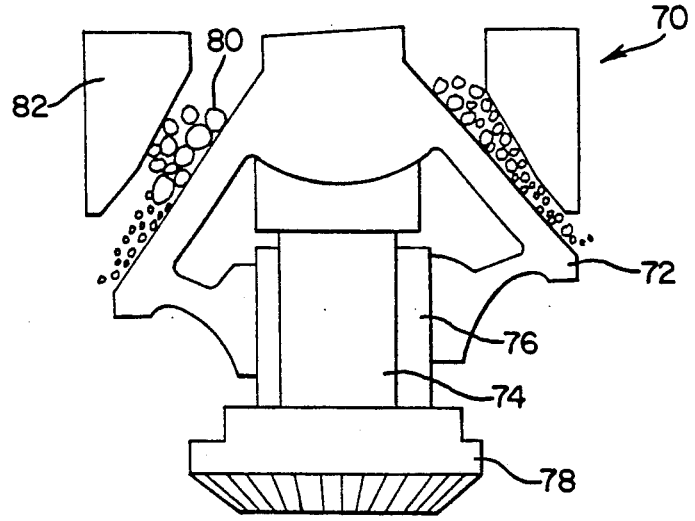
FIG. 3 is a diagrammatic vertical sectional view of a conical crusher of the type which may employ the present method.

Referring now to FIG. 3, a conical crusher is diagrammatically indicated at 70. The crusher basically includes a conical head 72 which is gyrated about a vertical shaft 74 by an eccentric 76 powered by a drive system 78. Incoming feed material 80 is crushed between the gyrating head 72 and a fixed bowl 82. As is the case in jaw crushers, in conical crushers, the above relationships between capacity, force, horsepower, speed and throw or stroke are basically the same. Also, in a conical crusher, the speed is varied by adjusting the eccentric drive system 78, and the throw is adjusted by changing the configuration of the eccentric 76.

Figure 4:
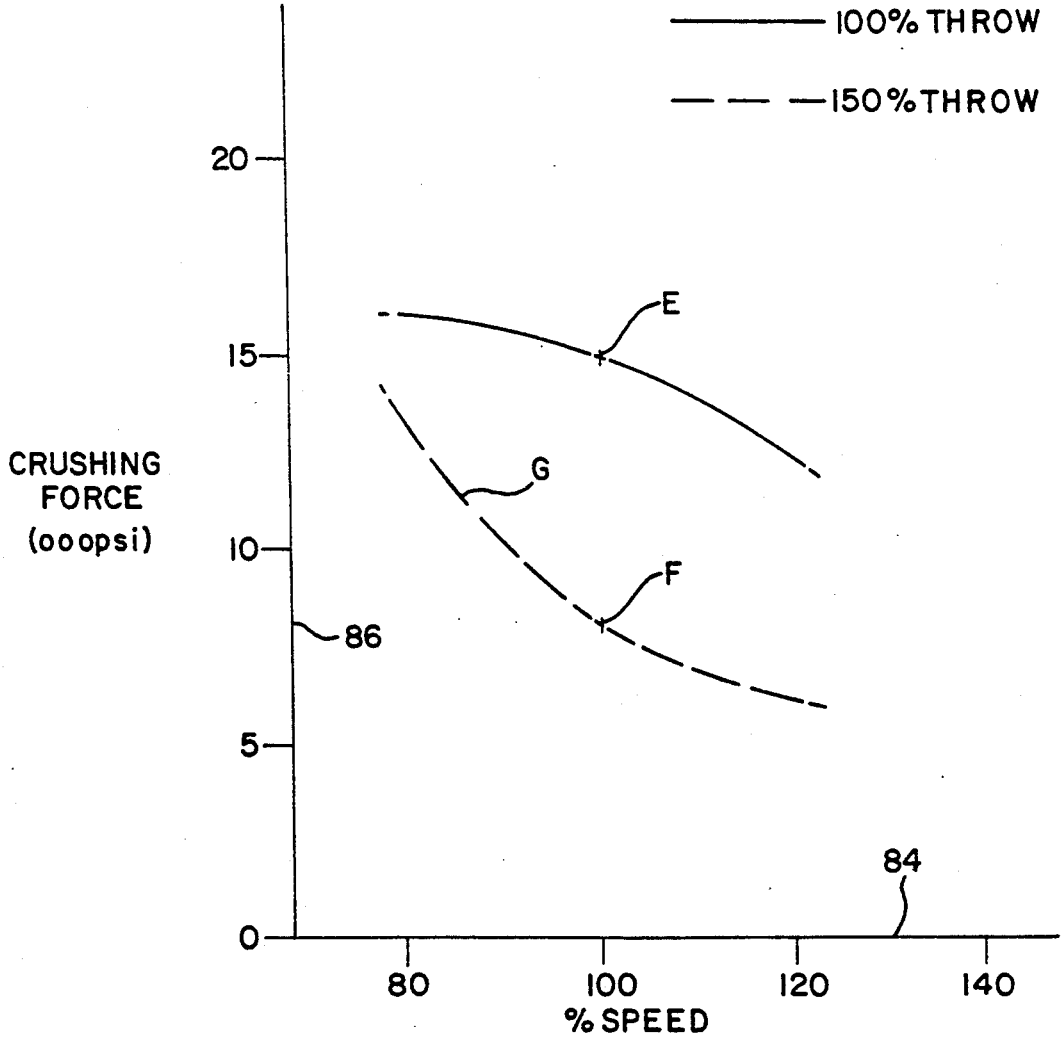
FIG. 4 is a graphical representation of the relationship of crushing force of a conical crusher compared with percent speed, for crushers adjusted for 100% and 150%, respectively, of specified throw.

Referring now to FIG. 4, a graphical representation of the performance of a conical crusher is shown in which percent speed, on the x-axis 84, is compared with crushing force, in terms of psi in thousands, on the y-axis 86. Generally speaking, a comparison of FIGS. 2 and 4 reveals that the same principles hold for jaw crushers as for conical crushers. Specifically, comparing line 88, representing 100% throw, with line 90, representing 150% throw over the specified level for the crusher 70, reveals that at 100% speed, increasing the throw 150% reduces the crushing force by approximately 50%. This is shown by a comparison of point E indicating approximately 15,000 psi at 100% speed, with point F indicating approximately 7,000 psi with a 150% increase in throw. It is also evident that, when compared to the effect of changes in throw, changes in crusher speed from the specified design parameters have a less significant effect on crushing force, although increasing the speed acts to decrease the force.

Also, as is the case with jaw crushers, by increasing the throw, and by maintaining or decreasing the speed of a conical crusher as represented at point G, the above-identified desired results of increased throughput capacity and applied connected motor power may be increased while remaining within acceptable force or machine stress load parameters for a particular machine design.

While a particular embodiment of the method of adjusting a crusher for high performance operation of the invention has been shown and described, it will be appreciated by those skilled in the art that changes and modifications may be made thereto without departing from the invention in its broader aspects and as set forth in the following claims.

What is claimed is:

1. A method of operating a jaw crusher having a specified speed, a specified throw, and a specified horsepower draw to achieve a specified maximum operational crushing force and a resulting crusher throughput capacity, comprising increasing said throw over said specified level and decreasing said speed below said specified level so that said capacity is increased without exceeding said crushing force, thus enabling an increase in crusher production without increasing the physical size of the jaw crusher.

2. The method as defined in claim 1 wherein said throw is increased on a percentage basis greater than said speed is reduced.

3. The method as defined in claim 1 in which said specified throw is determined by a specified eccentric shaft provided with the crusher, said shaft having a specified eccentric configuration, said method further including replacing said specified eccentric shaft with an eccentric shaft having an increased eccentricity to provide increased throw.

4. A jaw crusher including a housing having at least one movable jaw with a crushing surface which is adapted to follow a crushing cycle of movement against a like crushing surface, said crusher also being designed to have a specified speed, and a specified stroke determined by an eccentric having a specified configuration, and designed to operate at a specified crushing force, said crusher comprising an eccentric having an increased stroke over said specified stroke, and a speed which is decreased below said specified speed so that a specified increased throughput capacity is achieved without increasing crushing force, thus enabling an increase in crusher production without increasing the physical size of the jaw crusher.

* * * * *